US011208294B2

(12) United States Patent
Tschuppert et al.

(10) Patent No.: US 11,208,294 B2
(45) Date of Patent: Dec. 28, 2021

(54) SENSOR NETWORK FOR A PASSENGER TRANSPORT SYSTEM

(71) Applicant: Inventio AG, Hergiswil (CH)

(72) Inventors: Reto Tschuppert, Lucerne (CH); Martin Kusserow, Lucerne (CH)

(73) Assignee: INVENTIO AG, Hergiswil (CH)

( * ) Notice: Subject to any disclaimer, the term of this patent is extended or adjusted under 35 U.S.C. 154(b) by 269 days.

(21) Appl. No.: 16/492,190

(22) PCT Filed: Mar. 27, 2018

(86) PCT No.: PCT/EP2018/057702
§ 371 (c)(1),
(2) Date: Sep. 9, 2019

(87) PCT Pub. No.: WO2018/178037
PCT Pub. Date: Oct. 4, 2018

(65) Prior Publication Data

US 2021/0139274 A1 May 13, 2021

(30) Foreign Application Priority Data

Mar. 28, 2017 (EP) ..... 17163401

(51) Int. Cl.
*B66B 1/34* (2006.01)
*B66B 5/06* (2006.01)
*B66B 27/00* (2006.01)

(52) U.S. Cl.
CPC ..... *B66B 1/3446* (2013.01); *B66B 1/3438* (2013.01); *B66B 5/06* (2013.01); *B66B 27/00* (2013.01)

(58) Field of Classification Search
CPC ..... B66B 1/3415; B66B 3/00; B66B 3/002; B66B 1/24; B66B 1/3461; B66B 5/0012;
(Continued)

(56) References Cited

U.S. PATENT DOCUMENTS 5,360,952 A * 11/1994 Brajczewski ..... B66B 1/34 187/248
5,387,769 A * 2/1995 Kupersmith ..... B66B 1/3415 187/248
(Continued)

FOREIGN PATENT DOCUMENTS

CN 201395481 Y 2/2010
CN 102405185 A 4/2012
(Continued)

*Primary Examiner* — Marlon T Fletcher
(74) *Attorney, Agent, or Firm* — William J. Clemens; Shumaker, Loop & Kendrick, LLP

(57) ABSTRACT

A passenger transport system sensor network has a master unit, a signal-transferring apparatus, and a plurality of sensor nodes each having at least one sensor sensing a physical measurement variable and transferring the sensed variable to the master unit via the signal-transferring apparatus. A sensor-identifying module in the master unit determines the identity of the sensors from information, stored in a database, of: a first information type about reference measurement results to be typically provided by a particular sensor under already known conditions; a second information type about the identity of a sensor node containing the particular sensor, the sensor node having a plurality of different sensors or a plurality of identical sensors in different configurations; and/or a third information type about a configuration of a sensor node holding the particular sensor, which configuration was defined in advance. Sensor identities and installation locations can be determined in an automated manner.

13 Claims, 1 Drawing Sheet

(58) Field of Classification Search
CPC ..... B66B 3/02; B66B 1/34; B66B 2201/4676; B66B 1/3492; B66B 2201/20; B66B 1/3446; B66B 1/3453; B66B 2201/4669; B66B 25/00; B66B 27/00; B66B 5/0037; B66B 1/2458; B66B 1/3423; B66B 1/466; B66B 1/467; B66B 5/0018; B66B 1/3438; B66B 29/00; B66B 5/022; B66B 7/1215
See application file for complete search history.

(56) References Cited

U.S. PATENT DOCUMENTS

| | | | | |
|---|---|---|---|---|
| 7,373,228 | B2 | 5/2008 | Taguchi et al. | |
| 10,351,392 | B1 * | 7/2019 | Gurvich | B66B 29/00 |
| 2005/0098390 | A1 | 5/2005 | Angst | |
| 2018/0086597 | A1 * | 3/2018 | Song | G05B 15/02 |
| 2018/0354748 | A1 * | 12/2018 | Lustenberger | B66B 5/0093 |
| 2019/0382237 | A1 * | 12/2019 | Witczak | B66B 3/002 |
| 2021/0139274 | A1 * | 5/2021 | Tschuppert | B66B 27/00 |
| 2021/0171320 | A1 * | 6/2021 | Dong | B66B 27/00 |

FOREIGN PATENT DOCUMENTS

| | | | |
|---|---|---|---|
| CN | 103987645 | A | 8/2014 |
| CN | 104816992 | A | 8/2015 |
| CN | 105283404 | A | 1/2016 |
| CN | 106458507 | A | 2/2017 |
| EP | 0467673 | B1 | 10/1997 |
| JP | 2010095342 | A | 4/2010 |
| JP | 2014172721 | A | 9/2014 |
| WO | 2005096571 | A1 | 10/2005 |
| WO | 2010092152 | A1 | 8/2010 |
| WO | 2014027934 | A1 | 2/2014 |
| WO | 2016174718 | A1 | 11/2016 |

* cited by examiner

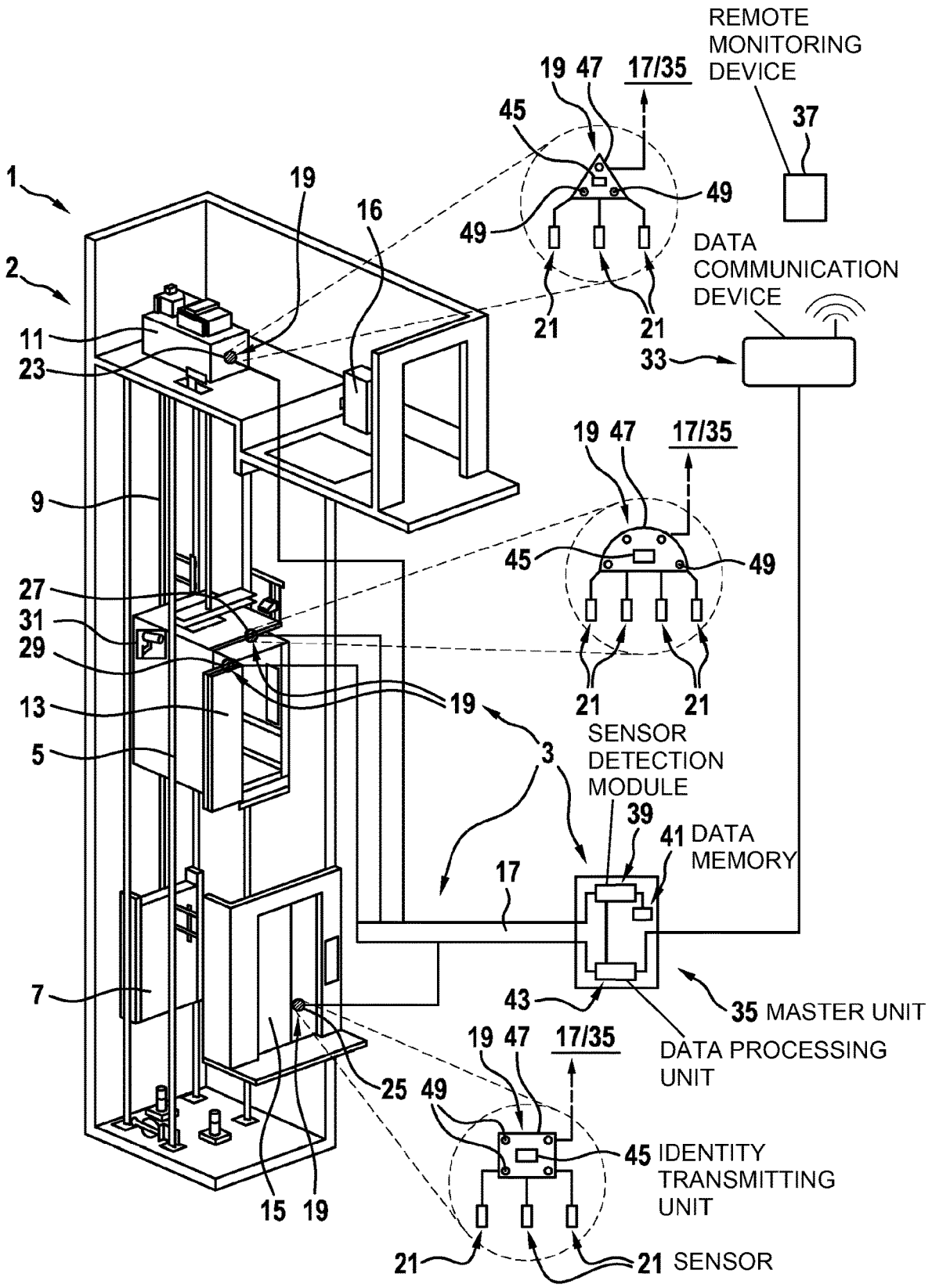
REMOTE MONITORING DEVICE
37
19 47 17/35
45
49
49
21
21
DATA COMMUNICATION DEVICE
33
1
2
11
23
19
16
9
27
31
29
13
5
19 47 17/35
45
49
21
21
19
3
SENSOR DETECTION MODULE
39
41 DATA MEMORY
17
7
43
35 MASTER UNIT
DATA PROCESSING UNIT
19 47 17/35
25 49
45 IDENTITY TRANSMITTING UNIT
15 19
21
21 SENSOR

SENSOR NETWORK FOR A PASSENGER TRANSPORT SYSTEM

FIELD

The present invention relates to a sensor network for passenger transport installations such as elevators, escalators or moving walkways. The invention further relates to a passenger transport installation equipped with such a sensor network. Furthermore, the invention relates to a method for determining an identity of sensors in a sensor network for a passenger transport installation and to a method for retrofitting an existing passenger transport installation.

BACKGROUND

Passenger transport installations such as elevators, escalators or moving walkways are used to transport people and/or goods in a building or structure from one place to another. The passenger transport installation as a whole is permanently installed in the structure, but has components such as an elevator car that can move between floors or a circulating conveyor staircase or such a conveyor walkway by means of which, for example, passengers can be transported.

In order to be able to identify operating conditions of the passenger transport installation and in particular any anomalies in such operating conditions, it is possible to monitor operating parameters of the passenger transport installation continuously or repeatedly at specific time intervals. For example, it may be necessary to know a current operating state in order to be able to subject it to open-loop or closed-loop control appropriately. It may also be advantageous or necessary to detect anomalies in the operating conditions at an early stage, in order to take measures to remedy these if necessary.

For example, in an elevator, it may be advantageous to monitor whether its components are functioning properly. In particular, it is possible to monitor whether an elevator car can be moved properly and/or whether elevator car doors open and close properly, since anomalies with regard to moving the elevator car or with regard to a closing function of the doors can undermine both the safety of the elevator installation and comfort for passengers. For example, improperly-closing elevator car doors can lead to the risk of passengers being injured by the door or by an elevator starting despite an improperly closed door. Alternatively, an improperly moving elevator car door can cause inconveniences such as disturbing noises. An elevator car that is not moving properly can cause delays in the operation of the elevator installation, noise, or, in the worst case, even hazards to passengers.

Similarly, in an escalator or moving walkway, for example, incorrect shifting of treads or pallets may pose dangers or at least inconveniences, for example in the form of noise, to passengers.

To detect operating conditions, a large number of different operating parameters can be monitored in a passenger transport installation, for example by means of sensors. The sensors can be arranged so as to be distributed over the passenger transport installation. An operating parameter in this case can be a physical variable which exists during operation of the passenger transport installation and which possibly changes in the course of the operation of the passenger transport installation. Operating parameters can be, for example, currently flowing or averaged electrical currents to components such as electric motors or actuators in the passenger transport installation, noise in or adjacent to the passenger transport installation, current accelerations on or within components of the passenger transport installation, temperatures in or adjacent to components of the passenger transport installation, etc.

In conventional passenger transport installations, the operating parameters are usually monitored using components already integrated into the passenger transport installation by the manufacturer. For example, the operating parameters can be monitored by monitoring control variables of a controller that controls the passenger transport installation, in particular with regard to possible anomalies. Alternatively or additionally, various sensors such as acceleration sensors, sound sensors (microphones), temperature sensors, sensors for detecting electrical or magnetic fields, etc. may be provided in the passenger transport installation, by means of which operating parameters to be monitored can be measured. The sensors can be provided at various points within the passenger transport installation, in particular on components to be monitored of the passenger transport installation. Signals provided by the sensors can be utilized directly in the passenger transport installation, but they can also be used to monitor the passenger transport installation from a remote location, for example from a remote control center.

In particular in the case of older passenger transport installations, it may be necessary or desirable to modernize these installations with regard to the safety, reliability and/or comfort thereof. In this case, it may be desirable, inter alia, to retrospectively create technical conditions in order to be able to monitor specific operating parameters. For example, a sensor system can be retrofitted into an existing passenger transport installation which has, for example, a large number of sensors and a signal processing means or an evaluation means for processing signals from the sensors, so that operating parameters can be monitored using this apparatus and, for example, possible anomalies can be identified at an early stage.

In older passenger transport installations, the various sensors provided therein are usually fixedly wired to a central controller in the form of an elevator controller or a separate evaluation means. This creates a considerable amount of wiring, in particular in large passenger transport installations.

In newer passenger transport installations, therefore, the various sensors are no longer individually wired to the elevator controller or evaluation means, but instead a signal transmission means such as a bus system is provided to which each of the sensors can be connected and by means of which each of the sensors can exchange signals with the elevator controller or evaluation means. Alternatively, a wireless network can also be used as a signal transmission means. The sensors form a sensor network together with the signal transmission means and the elevator controller or evaluation means acting as a master unit.

In this case, however, the problem may arise that the elevator controller or evaluation means must always know from which of the sensors certain signals originate in order to evaluate these signals appropriately. Since the respective identities of the sensors can no longer be determined on the basis of their fixed individual wiring, an identity of the sensors in the sensor network must be known in advance.

Conventionally, for this purpose, the identity of each of the sensors contained in the sensor network is established in a suitable manner prior to putting the sensor network into operation. For example, each of the sensors may be given an individual identity by providing each one with uniquely identifiable characteristics, such as an identification code (ID) stored in an electronic memory or so-called "tag". Such an ID can for example be set individually by means of appropriately adjustable microswitches or by storing in a programmable memory at each of the sensors. However, this requires individually providing each of the many sensors in the passenger transport installation with a unique ID in advance. This can involve considerable effort, for example, when producing the sensors and/or on the part of maintenance personnel configuring the passenger transport installation.

By way of example, JP 2014172721 A describes a wireless sensor network system for an elevator installation, in which manual configuration appears to be necessary.

WO 2010/092152 A1, WO 2005/096571 A1, WO 2016/174718 A1 and US 2005/098390 A1 describe sensor network systems in which logical addresses and/or identifiers of the individual sensors are used to identify the sensors.

SUMMARY

There may be, inter alia, a need for a sensor network for a passenger transport installation that can be provided and installed in the passenger transport installation simply, reliably, with little effort and/or inexpensively. Furthermore, there may be a need for a passenger transport installation equipped with such a sensor network. In particular, there may be a need for a method by means of which the respective identities of sensors in such a network can be determined simply, reliably and/or with little effort. Furthermore, there may be a need for a method for retrofitting a passenger transport installation with an easy-to-configure sensor network.

A need of this kind can be satisfied by the subject matter of the invention and advantageous embodiments are defined in the following description.

According to a first aspect of the invention, a sensor network for a passenger transport installation is proposed. The sensor network comprises a master unit, a signal transmission means and a plurality of sensor nodes. Each sensor node comprises at least one sensor, preferably a plurality of sensors, for detecting a physical measured variable and is designed to transmit the detected measured variable to the master unit by means of the signal transmission means. To transmit the detected measured variable, the sensor node has, in particular, what is known as a host, that is to say a control means. The master unit comprises a sensor detection module which is designed to determine an identity of the at least one sensor of each of the sensor nodes by taking into account information previously stored in a database. In this case, the information can be: (i) a first type of information comprising information about reference measurement results to be typically provided by a particular sensor under known conditions; (ii) a second type of information comprising information about an identity of a sensor node containing the particular sensor; and/or (iii) a third type of information comprising information about a pre-established configuration of a sensor node accommodating the particular sensor.

According to a second aspect of the invention, a passenger transport installation, in particular an elevator installation, an escalator or a moving walkway, is proposed, which comprises a sensor network according to an embodiment of the first aspect of the invention.

According to a third aspect of the invention, a method for determining an identity of sensors in a sensor network for a passenger transport installation is proposed. The sensor network in this case comprises a master unit, a signal transmission means and a plurality of sensor nodes. Each sensor node comprises at least one sensor for detecting a physical measured variable and is designed to transmit the detected measured variable to the master unit by means of the signal transmission means. The method comprises determining the identity of the at least one sensor of each of the sensor nodes by taking into account information previously stored in a database of: (i) a first type of information comprising information about reference measurement results to be typically provided by a particular sensor under known conditions; (ii) a second type of information comprising information about an identity of a sensor node containing the particular sensor; and/or (iii) a third type of information comprising information about a pre-established configuration of a sensor node accommodating the particular sensor.

According to a fourth aspect of the invention, a method for retrofitting a passenger transport installation is proposed, in which a sensor network according to an embodiment of the first aspect of the invention is installed in the passenger transport installation and an identity of sensors in the sensor network is determined by means of the method according to an embodiment of the third aspect of the invention.

Possible features and advantages of embodiments of the invention may be considered, inter alia and without limiting the invention, to be dependent upon the concepts and findings described below.

As noted above in the introductory part, sensors have frequently been used in conventional passenger transport installations in order to monitor current conditions within the passenger transport installation by repeatedly measuring operating parameters. Each sensor was wired individually to an elevator controller or evaluation unit. Alternatively, in modern passenger transport installations, bus systems were used via which it was possible for a large number of sensors to communicate with the controller or evaluation unit, although in this case, each of the individual sensors had to be assigned a unique identifier (ID) in advance.

The above-mentioned approach made it possible for all the sensors to be individually wired using less effort. However, the sensors had to be made individually distinguishable before putting the passenger transport installation into operation. For this purpose, each individual sensor had to be individually configured after it was installed in the passenger transport installation, which often required considerable effort on the part of the installing personnel. Alternatively, each of the sensors had to already be configured by the manufacturer in advance, for example after it was produced, by programming an ID into a memory provided therein, for example. However, this resulted in a considerable logistical effort on the part of the installing personnel, since each of the sensors individually customized in advance had to be reliably installed at a location intended therefor. A mixture of internally different but possibly outwardly similar-looking sensors resulted in the elevator controller or evaluation unit not being able to appropriately associate, and thus appropriately evaluate, received signals when said sensors are mounted in the passenger transport installation.

Embodiments of the present invention make it possible for a sensor network to have a large number of sensors which can jointly communicate, by means of a signal transmission means such as a bus system, with an elevator controller or evaluation unit that functions as a master unit, and also to be able to minimize the effort involved in configuring the sensors before putting the sensor network into operation as well as the logistical effort involved in installing the sensor network.

A basic concept here can be considered to be equipping the master unit with a special sensor detection module. This sensor detection module is intended to be able to unambiguously determine an identity of each of the sensors contained in the sensor network on the basis of information available to it.

Use can be made, for example, of the fact that certain sensors within the sensor network are intended to provide certain measurement results under certain known conditions, such that different sensors contained in the sensor network can be distinguished from one another on the basis of their detected measurement results when adjusting the known conditions.

Alternatively or additionally, use can be made of the fact that each of the sensors is associated with a sensor node, it being possible for individual sensor nodes to accommodate a plurality of sensors and for the identity of the sensor nodes to be known in advance by the sensor detection module, such that the sensor detection module can indirectly also deduce the identity of the sensors associated therewith.

As a further alternative or addition, information can be made available to the sensor detection module about configurations of sensors accommodated in a sensor node, which configurations are pre-established therein, such that the sensor detection module can use this configuration to deduce the identity of the sensors accommodated therein.

In all three variants, the sensor detection module can autonomously, that is to say preferably automatically, determine the identity of each of the sensors contained in the sensor network on the basis of information previously stored in a database. In this case, the information stored in the database does not directly indicate the identity of each individual sensor, but merely allows the identity of each individual sensor to be indirectly deduced. Possible types of information types stored in the database are explained in detail below.

The master unit is designed in particular as an evaluation unit that is independent of the elevator controller. It is possible that the master unit is part of the sensor network only during a configuration phase, that is, while the sensor network configuration is being carried out, checked, or changed. In normal operation, the sensor nodes can send the detected measured variables independently to a remote monitoring device. In this case, for example, it is possible for the master unit to be realized by a mobile terminal, for example a mobile telephone.

According to one embodiment, a plurality of the sensors contained in the sensor network may be identical in terms of their physical design.

In other words, the characteristic that the master unit contained in the proposed sensor network is provided with the sensor detection module which allows the identity of each individual sensor to be deduced on the basis of information previously stored in said module, can make it possible for the sensors contained in the sensor network not to have to differentiate on the basis of physical designs.

In other words, a plurality of sensors of the same sensor type to be used in the sensor network, that is to say for example a plurality of acceleration sensors which are intended to measure accelerations acting at different positions within a passenger transport installation, may be identical in terms of physical design.

The physical design should be understood in this context to mean a sum of physical features of a sensor, on the basis of which features an individual sensor could be distinguished from another sensor, for example. This can include static properties of the sensor such as its housing or fixed wiring within its circuits, but also properties that are variable in principle such as modifiable settings of microswitches provided on a sensor or modifiable microscopic structures within a memory provided in the sensor. In other words, sensors within the sensor network may be identical in terms of both their static physical design and also in terms of their potentially variable physical design.

This is made possible because in the sensor network proposed herein, the individual physical design of one of the sensors is not needed in order to be able to detect the identity of the sensor. Accordingly, a plurality of sensors of one sensor type can be identical in terms of their static physical design, that is to say, for example, the components contained in a sensor may be the same in terms of their structural design. Even if additionally variable physical designs are provided in one sensor type, such as microswitches or a variably programmable electronic memory, these can be identical in terms of their macroscopic or microscopic physical design when the sensor network is in operation, that is to say, the microswitches can be switched in the same way or the memories can be programmed in the same way, since these variable physical designs are not needed to determine the identity of a particular sensor.

The possibility of being able to design a plurality of sensors identically within a sensor network makes simplified production of standardized sensors possible. The installation or configuration of the sensor network can also be simplified since any individual sensor of one sensor type can be installed at any point where such a sensor type is to be provided within a sensor network, without having to take into account individual identities of the particular sensor. This can significantly reduce logistical effort or configurational effort.

According to one embodiment, the signal transmission means of the sensor network may be a bus system to which a plurality of sensor nodes can be connected and by means of which each of the plurality of sensor nodes can direct signals generated by the sensors thereof to the master unit.

In other words, for signal transmission between the individual sensors and the master unit, a bus system can be used to which each of the sensor nodes is connected, such that each of the sensors contained in a sensor node can exchange signals, via its associated sensor node and the bus system connected thereto, with the master unit. Each sensor can therefore direct its own signals to the master unit and, for example, receive control signals from the master unit. The bus system in this case can be wired or wireless. The bus system can transmit signals between the master unit and a large number of sensors. In particular, in a wired bus system, individual wiring is not needed for each individual sensor; rather, a plurality of sensors can communicate with the master unit via a shared wiring. The master unit, having been able to associate the identity of each individual sensor connected to the bus system by means of its sensor detection module, can individually associate the signals received by means of the bus system with each sensor and thus process said signals appropriately. The bus system can also be designed as a wireless network.

According to one embodiment, the identity of a sensor may include information about its installation location within the passenger transport installation.

In other words, it may be advantageous for the master unit not to be able to deduce, or at least not necessarily, a physical design of the sensor by determining the identity of each sensor using the sensor detection module thereof, but rather to be able to determine at what position said sensor is arranged within the sensor network or within the passenger transport installation. Depending on where the sensor is located within the passenger transport installation, it may be used to monitor different local physical conditions within the passenger transport installation. For example, acceleration sensors, which are identical in terms of their physical designs, but are used at different positions within the passenger transport installation, can measure different conditions within the passenger transport installation. By being able to detect the identity of a sensor and thus information about its installation location within the passenger transport installation, the master unit can appropriately evaluate the signals provided by this sensor.

According to one embodiment, the master unit may comprise a data memory, preferably an electronic data memory, in which the information stored in the database is stored.

In other words, the information needed by the sensor detection module of the master unit to determine the identity of each of the sensors contained in the various sensor nodes may be stored in a database that is stored in a data memory in the master unit. The data memory may be, for example, a programmable electronic data memory such as a flash memory, a PROM, an EPROM, a RAM or the like.

Alternatively, instead of storing the database provided with information directly in a data memory within the master unit, such a database may also be stored in an external data memory, for example in a data cloud, and the required information can be called-up therefrom by the sensor detection module as needed.

The three types of information, on the basis of which information the sensor detection module can deduce the identity of a sensor, as well as ways in which the sensor detection module can then deduce the identity of a sensor on the basis of this information, are explained in the following in greater detail.

The first type of information includes information about reference measurement results to be typically provided by a particular sensor under known conditions. In this case, the sensor detection module can detect the identity of a sensor by the sensor being operated under the aforementioned known conditions and then the signals provided by the sensor being compared with the known reference measurement signals. Depending on which of a plurality of reference measurement results stored in the database the actual measurement results of the sensor match with or at least correlate with within certain tolerances, the identity, and thus for example an actual installation location of a sensor, can be deduced. In this case it is in particular known by the sensor detection module what type of sensor the sensor in question is, that is to say, for example, an acceleration sensor, a sound sensor (microphone) or a temperature sensor.

The known conditions may in this case be, for example, certain operating conditions within the passenger transport installation. The reference measurement results to be typically provided may be the measurement results that a particular type of sensor provides, for example if it is installed at a particular installation location within the passenger transport installation and provides measurement results under the known conditions.

According to one embodiment, in the case of the first type of information, the master unit is designed, during an initialization process in which the passenger transport installation is prompted to assume the known conditions, to compare measurement results actually provided by sensors contained in the sensor network with the reference measurement results previously specifically stored in the database for each of the sensors and to determine, on the basis thereof, the identity of the particular sensor.

In other words, the first type of information may include information as to which measurement results each of a large number of sensors in the passenger transport installation provides when operated under certain known conditions. These measurement results are stored as reference measurement results in the database. The reference measurement results can be determined, for example, as early as in a planning phase of a passenger transport installation and/or during or directly after manufacture of the passenger transport installation, for example by means of experiments and/or simulations.

For example, for each of the sensors to be included in a sensor network, it can be established in advance how said sensor behaves under standardizable known conditions, that is to say, which measurement results it should provide under these conditions. If these conditions are subsequently reproduced during an initialization process after the sensor network has been installed in a passenger transport installation, then the identity of each of the sensors, in particular its installation location within the passenger transport installation, can be deduced on the basis of the signals provided by the various sensors. During the initialization process, measurement results actually provided by the sensors are thus compared with the reference measurement results previously specifically stored in the database for each of the sensors.

In principle, it may be sufficient not to determine reference measurement results in advance for all the sensors installed in the sensor network and store them in the database, but simply to maintain such information about reference measurement results for at least one sensor for each of the sensor nodes contained in the sensor network. If, as a result, the identity of this particular sensor can be deduced, the identity of the sensor node, and thus also indirectly the identity of further sensors provided in said sensor node, can be indirectly deduced.

According to a specific embodiment, it may be the case, for example, that during the initialization process the passenger transport installation is prompted to move a passenger conveyor unit such as an elevator car of an elevator installation, a step belt of an escalator or a pallet belt of a moving walkway in a predetermined manner along a conveying path as part of a test run. In this case, the master unit may be designed to record current accelerations measured by acceleration sensors contained in the sensor nodes and to determine the identity of the acceleration sensor recording the current accelerations on the basis of a comparison of these measured prevailing accelerations with previously determined reference measurement results.

In other words, it is possible to establish how each of a plurality of acceleration sensors would have to behave within the passenger transport installation before the passenger transport installation is put into operation, i.e. before the initialization process is carried out, that is to say, which measurement results it would have to provide if the passenger transport installation were operated in a predetermined way during a test run such that a passenger conveyor unit is moved in an established pattern along a conveying path. Corresponding reference measurement results can be ascertained, for example, for an acceleration sensor which is provided on the passenger conveyor unit and is moved along therewith. However, corresponding reference measurement results can also be ascertained for other acceleration sensors which are provided for example on a drive unit, a fixed suspension point or on other components that typically move while the passenger transport installation is in operation. Since the various components of the passenger transport installation move significantly differently during the test run and therefore the acceleration sensors provided thereon provide significantly different measurement results, the various acceleration sensors, if these measurement results were previously determined as reference measurement results, can be identified during an initialization process to be carried out later by comparing the current accelerations actually measured with the reference measurement results.

The second type of information contains information about an identity of a sensor node containing the particular sensor. In other words, the second type of information, unlike the first type of information, does not contain information that characterizes the properties of the particular sensor itself, but rather information that does not characterize the identity of the sensor itself but instead characterizes the identity of the sensor node containing the particular sensor. A sensor node contains a plurality of sensors, with a single sensor node not containing two of the same sensors in the same configuration, but a plurality of different sensors or a plurality of the same sensors in different configurations. If the sensor detection module can therefore be provided with information about the identity of a sensor node via the database, the module can indirectly also determine information about identities, in particular installation locations, of the sensors accommodated therein.

For example, the sensor detection module can determine the specific type of a sensor on the basis of the sensor data provided by this sensor and can determine, for example, an installation location of this sensor within the passenger transport installation on the basis of the identity of the sensor node comprising this sensor.

According to one embodiment, in the case of the second type of information, the master unit is designed to determine the identity of a particular sensor on the basis of a comparison of an identity signal transmitted by the sensor node comprising the sensor with reference data stored in advance in the database.

In other words, the sensor detection module provided in the master unit can receive an identity signal from a particular sensor node contained in the passenger transport installation and compare this signal with reference data stored in advance in the database. In this case, the reference data can provide information, for example, as to the installation location at which the sensor node provided with the identity signal is installed within the passenger transport installation. If the identity of the particular sensor node could be deduced by comparing the transmitted identity signal with previously stored reference data, it is then possible to indirectly also deduce identities of the various sensors provided in this sensor node.

According to a specific embodiment, one sensor node, on account of its design, can be installed only at a configurationally predetermined position within the passenger transport installation. Each sensor node may in this case have an identity transmitting unit which can transmit the identity signal specific to the sensor node to the master unit or the sensor detection module thereof. In this case, the master unit or the sensor detection module provided therein may be designed to determine the position at which a sensor is installed within the passenger transport installation on the basis of a comparison of the identity signal transmitted by the identity transmitting unit of the sensor node with the reference data stored in advance in the database, which data indicate the configurationally predetermined position within the passenger transport installation.

In other words, it is possible, for example as early as the planning stage of a sensor network for a passenger transport installation, to specify at which position, that is to say at which installation location, within the passenger transport installation a specific sensor node is to be installed. In order for the particular sensor node to actually also be installed at this position, it may be the case that, due to its design, it can be installed exclusively at this configurationally predetermined position.

For example, the sensor node may comprise a housing that has a unique geometry and a corresponding housing receptacle with a complementary, matching geometry can be provided in the passenger transport installation, such that the particular sensor node can be installed exclusively at the position predetermined for this purpose. Alternatively, for example, the housing of a sensor node may be equipped with a unique screwing pattern such that it can only be screwed to a housing counterpart correspondingly equipped with a matching screwing pattern in the passenger transport installation.

Each sensor node should have its own identity transmitting unit. This identity transmitting unit can transmit the identity signal specific to the sensor node to the master unit or the sensor detection module thereof. For example, an identity transmitting unit may be a "tag", for example an RFID tag, which can send out an identity signal unique to the sensor node. The identity transmitting unit can also send the identity signal unique to the sensor node to the sensor detection module by means of the signal transmission means. The information as to which identity signal has a specific sensor node provided for installation at a configurationally predetermined position can be stored in advance in the database which can be called up by the sensor detection module. For example, such information can be planned as early as during the planning stage of the passenger transport installation.

As part of an initialization process, the sensor detection module of the master unit can then deduce the identity of the sensor node sending the identity signal on the basis of a comparison of the identity signal transmitted by a sensor node with the reference data stored in advance in the database and, since this sensor node can be installed exclusively at its configurationally predetermined position, thus indirectly deduce the predetermined position of the sensor within the passenger transport installation.

The third type of information includes information about a pre-established configuration of a sensor node accommodating the particular sensor. This third type of information therefore does not directly contain information with respect to the identity of a specific sensor, but only with respect to a pre-established configuration of a sensor node containing said sensor.

It is assumed, for example in the context of planning a passenger transport installation, that it is established in advance which sensor node is to be equipped at which position within the passenger transport installation with which sensors in order to be able to appropriately measure local condition parameters of the passenger transport installation. Since the information about such a configuration is therefore known in advance, it can already be stored in the database which can be called up by the sensor detection module. This can occur at a point in time when it is not yet known which specific sensors are to be installed in the sensor node. In other words, although it may already be known that in the sensor node, for example, a temperature sensor, an acceleration sensor and a sound sensor are to be installed, it does not yet need to be known which specific type, for example of an acceleration sensor, is to be used.

From merely the knowledge of what configuration a sensor node should have within the passenger transport installation, the identity of the sensor node can be deduced later, for example during an initialization process. For example, signals transmitted from the sensor node to the master unit may be analyzed in order to detect what types of sensors are contained in the sensor node in question. By comparing this information with the pre-established configuration, it is possible to deduce the identity of the sensor node and, in turn, to indirectly deduce therefrom the identity of the sensors contained in said sensor node.

According to one embodiment, in the case of the third type of information, the pre-established configuration may include information about a configuration-appropriate type and number of sensors contained in one of the sensor nodes. The master unit may in this case be designed to derive an actual type and number of sensors contained in the sensor node from measurement results actually transmitted by a sensor node, and to determine the identity of a particular sensor on the basis of a comparison of the derived actual type and number of sensors contained in the sensor node with the information indicated in the pre-established configuration about the configuration-appropriate type and number of sensors contained in one of the sensor nodes.

In other words, it can be established as early as the planning stage of a passenger transport installation which sensor node is intended to contain which type and number of sensors, since it was established, for example in a functional specification, which operating conditions are to be measured by means of a sensor node provided at a certain installation location. Before the sensor network is then put into operation, for example in an initialization process, it is possible to deduce the type and number of sensors contained in this sensor node from the actual signals provided by a sensor node and to compare these with the information stored in advance from the database. The identity of the sensor node and thus the sensors contained therein can thus be determined unambiguously.

It should be noted that some of the possible features and advantages of the invention are described herein with reference to different embodiments. In particular, some features and advantages related to a sensor network or a passenger transport installation equipped therewith and some features related to a method for determining an identity of sensors in a sensor network are described. A person skilled in the art recognizes that the features can be combined, transferred, adapted or replaced as appropriate in order to arrive at further embodiments of the invention.

Embodiments of the invention will be described below with reference to the accompanying drawings, with neither the drawings nor the description being intended to be interpreted as limiting the invention.

DESCRIPTION OF THE DRAWINGS

FIG. 1 shows a passenger transport installation in the form of an elevator comprising a sensor network according to the invention for monitoring operating parameters.

The drawing is merely schematic and is not to scale.

DETAILED DESCRIPTION

FIG. 1 shows a passenger transport installation 1 in the form of an elevator installation 2. The elevator installation 2 comprises an elevator car 5 and a counterweight 7 which can be moved in an elevator shaft by means of cables or belts 9 which are driven by a drive machine 11. The elevator car 5 has a car door 13. Furthermore, a plurality of shaft doors 15 are provided on the elevator shaft. Operation of the elevator installation 2, and in particular the drive machine 11, and the car door 13 and the shaft doors 15 is controlled by means of an elevator controller 16.

In order to be able to recognize currently prevailing operating conditions in the elevator installation 2, to be able to control the elevator installation suitably and/or in particular to be able to detect anomalies in the elevator installation 2, a sensor network 3 is provided in the elevator installation. The sensor network 3 has a plurality of sensor nodes 19 distributed over the elevator installation 2. Each of the sensor nodes 19 comprises at least one sensor 21, but usually a plurality of different sensors 21 (shown by way of example for the sensor node 19 located on the shaft door 15), and is designed to detect, by means of the sensors 21, specific operating parameters in the elevator installation 2 on or near an installation location of the particular sensor node 19.

Each of the sensor nodes 19 is connected to a master unit 35 via a bus system that is used as a signal transmission means 17, such that the sensors 21 contained in the sensor nodes 19 can transmit their measurement results in the form of, for example, electrical or electromagnetic signals to the master unit 35 and/or, conversely, the master unit 35 can control an operation of the sensors 21 by transmitting control signals.

For example, an elevator car sensor node 27 can be arranged on the elevator car 5. This sensor node can have for example one or more sensors, in particular acceleration sensors, sound sensors, temperature sensors and/or electrical or magnetic field detecting sensors, by means of which accelerations acting on the elevator car 5, noises occurring therein, and temperatures and/or fields prevailing therein can be detected. The elevator car sensor node 27 may further include a camera arrangement 31, by means of which, for example, an interior in the elevator car 5 or parts of the elevator shaft in the vicinity of the elevator car can be observed.

Furthermore, a drive machine sensor node 23 may be arranged on the drive machine 11. This sensor node may contain, for example, sensors 21, by means of which electrical power flows supplied to the drive machine 11, accelerations acting on the drive machine 11, for example in the form of vibrations, temperatures prevailing at the drive machine 11, noises occurring at the drive machine 11 and/or electrical and/or magnetic fields prevailing near the drive machine 11, etc. can be measured.

Furthermore, a car door sensor node 29 may be arranged on the car door 13. This sensor node can measure, by means of suitable sensors 21, for example, accelerations acting on the car door 13, noises occurring there, etc.

Similarly, a shaft door sensor node 25 can be arranged on each of the shaft doors 15. This sensor node can, for example, detect accelerations acting on the shaft door 15, noises occurring there, etc.

A fixing element sensor node (not shown) may be provided on a fixing element of the belt 9. In this case, the belts 9 may optionally be suspended elastically resiliently on statically fixed structures within a building by means of the fixing element, it being possible for example for acceleration sensors attached to the fixing element to provide information about movements of the fixing element.

The various sensor nodes 19 can transmit, by means of their sensors 21, signals which contain information about the operating parameters detected thereby, to the master unit 35. In said unit, the received signals can be suitably processed and/or evaluated in order to receive information about currently prevailing conditions within the elevator installation 2.

Optionally, the received signals can be sent to a remote monitoring device 37 via a data communication device 33 before or after said signals are processed or evaluated. The monitoring device 37 can be installed e.g. in a monitoring center in which, for example, the manufacturer of the passenger transport installation 1 can monitor the functioning thereof remotely.

However, in order for the master unit 35 to be able to appropriately evaluate the received signals, it must know from which of the many sensors 21 a particular signal was sent. In other words, the master unit 35 has to know the identity of a sensor 21 in order to correctly process and/or evaluate the signals it has received therefrom.

For this purpose, the master unit 35 has a sensor detection module 39. The sensor detection module 39 can exchange signals with each of the sensor nodes 19 by means of the signal transmission means 17. Furthermore, the sensor detection module 39 can retrieve information from a database, which information is stored, for example, in a data memory 41 within the master unit 35. The sensor detection module 39 is designed to be able to determine an identity, in particular an installation location, of the sensors 21 connected in the sensor network 3 and to provide this information to a data processing unit 43 so that said unit can appropriately evaluate the signals received by the sensors 21.

In a first possible embodiment, the sensor detection module 39 can determine the identity of a sensor 21 on the basis of measurement results measured by this sensor 21 under certain known conditions.

For this purpose, information about the reference measurement results to be typically provided by the particular sensor 21 under the known conditions is stored in the database as the first type of information. For example, these measurement results can be determined as early as during a planning phase or an adjustment phase, for example on the basis of experiments and/or simulations. After the sensor network 3 has been installed in the passenger transport installation 1, an initialization process can then be carried out, during which the passenger transport installation 1 is operated specifically under the known conditions. In this case, measurement results actually provided by the sensors 21 are then compared with the reference measurement results stored in advance in the database. On the basis of such a comparison, the identity of a particular sensor 21 can be deduced.

In one specific example, acceleration sensors for example may be provided in the car sensor node 27 and in the car door sensor node 29, the shaft door sensor node 25 and the drive machine sensor node 23 or a fixing element sensor node, in order to be able to measure the accelerations acting on the particular components at the time. In actual operation, for example during a test run, of the elevator installation 2, very different accelerations act on the various components. In particular, for example, the accelerations acting on the car 5 are generally significantly higher than, for example, the accelerations acting on the drive machine 11 or the fixing element of the belts 9. For example, it may be determined in advance what accelerations should typically occur on the various components during a test run. By then comparing the accelerations actually measured at the various sensors 21 with the previously determined reference measurement results in a test run carried out during the initialization process, the identity of the various acceleration sensors, i.e. in this specific case the installation location thereof, can be deduced.

The actual measurement results can be directly compared with the reference measurement results, taking into account potentially permissible tolerances in the process. Alternatively, a kind of ranking or sequence of the various measured sensor signals can also be taken into account as part of the comparison with the reference measurement results for associating the identities of the sensors 21. This means, for example, that a maximum measured acceleration can be associated with the sensor 21 on the elevator car 5, whereas, for example, much smaller measured accelerations can be associated with the sensor 21 at the fixing point for the belts 9.

According to a second embodiment, it is known for each sensor node 19 at which position, that is to say at which installation location, each sensor node is to be installed in the passenger transport installation 1.

For example, the sensor nodes 19 may be designed in such a way that on account of, for example, a shape of a sensor node housing 47, the sensor node 19 can only be installed at exactly one point within the passenger transport installation 1. Instead of the shape of the sensor node housing 47, a pattern of screw points 49 can also be individually predefined for each sensor node 19. In the drawing, three sensor nodes 19 having sensor node housings 47 of different geometries are shown by way of example, i.e. in the example shown having a triangular, rectangular or a semicircular sensor node housing 47. Additionally or alternatively, the patterns of the screw-on points 49 can also be formed with differently arranged screw-on points 49 and/or with different numbers of screw-on points 49. Each sensor node can direct signals measured by the sensors 21 connected thereto to the master unit 35 and optionally also directly to the controller 16, in a wired or wireless manner.

Each sensor node 19 has an identity transmitting unit 45, by means of which the sensor node 19 can transmit a specific identity signal to the master unit 35. The identity transmitting unit 45 may be, for example, a simple multiple microswitch in which a pattern of switching states unambiguously identifies the position or identity of the sensor node 19. Alternatively, the identity transmitting unit 45 may be a more complex electronic component such as a tag, an EEPROM, or an RFID/NFC. The identity transmitting unit 45 can, for example, send out the identity signal during a system start and thus notify the master unit 35 of the information as to the installation location at which the particular sensor node 19 is installed.

In this specific embodiment, the second type of information stored in the database is thus provided with information about the identity of a sensor node 19 containing the particular sensor 21. If, for example, as part of an initialization process, the identity signal transmitted by the identity transmitting unit 45 of the sensor node 19 is compared with the reference data stored in advance in the database, which data indicate the configurationally predetermined position of the sensor node 19 within the passenger transport installation 1, the information about the actual identity or the actual installation location of each of the sensor nodes 19 and thus also each of the sensors 21 can be derived as a result.

In such an embodiment, the sensor nodes 19 and the sensor node housings 47 thereof can advantageously be factory-assembled, and a service technician needs merely to install the sensor node housings 47 at the predetermined installation locations.

In a third embodiment, the third type of information to be stored in the database may contain information about a pre-established configuration of a sensor node 19 accommodating the particular sensor 21.

In this embodiment, the information required by the sensor detection module 39 in order to be able to detect the sensor nodes 19 is present as early as in a configuration or planning phase of the passenger transport installation 1. This information about the configuration of the passenger transport installation 1 and in particular about the sensor network 3 to be provided therein can be used later, for example during an initialization process, in order to be able to determine the identity of the sensor nodes 19 accommodated therein and thus of the installed sensors 21.

A possible configuration of a passenger transport installation is to be roughly described below:

In a sensor network 3, each sensor node 19, i.e. a combination of a host and one or more sensors 21, provides specific data, such as acceleration data, at a detection rate of, for example, 100 Hz. The sensor network 3 comprises a plurality of sensor nodes 19. A sensor node 19 comprises a host module and various sensors 21 attached thereto, for example in the form of modular hardware. In the planning stage of the passenger transport installation 1 various monitoring objectives are defined, that is to say, properties that are to be repeatedly monitored within the passenger transport installation 1, for example during the operation thereof. These may include, for example, the ride quality of the elevator car 5 and/or the car doors 13. On the basis of such monitoring objectives, it is possible to determine the functions and the parameters to be monitored for sensor nodes 19 to be provided on the respective components of the passenger transport installation 1. A configuration that indicates this, that is to say a kind of functional specification, contains, inter alia, information about the number and types of sensors 21 (for example accelerometers) and their installation locations (for example on the LDU (landing door unit), on a belt fixing element, on the elevator car 5, etc.), and possibly other mandatory or optional parameters (such as a detection rate of 100 Hz).

Whereas at the time of configuration of the passenger transport installation 1 the monitoring objectives to be achieved or monitoring functions to be used for this purpose are known, the specific hardware, that is to say the specific apparatuses used for this purpose, do not yet need to be known. Therefore, a mechanism is needed in order to be able to align the already defined functions that are to be realized by the sensor nodes 19 with the hardware actually installed. Moreover, in the case of modular hardware, it is not already known in advance at which installation location within the passenger transport installation 1 a specific apparatus is installed.

It is therefore proposed, by means of the sensor detection module 39 of the master unit 35, to carry out a method in which the monitoring objectives defined in advance are compared with the apparatuses actually installed, in particular the sensors 21 actually installed.

For this purpose, the pre-established configuration can be stored in advance as information about a configuration-appropriate type and number of sensors 21 contained in one of the sensor nodes 19 in the database. The sensor detection module 39 can then analyze, during an initialization process, measurement results actually transmitted by a sensor node 19, as to what type and number of sensors 21 are contained in the particular sensor node 19. This information can then be compared with the information stored in the database in order to derive therefrom the identity of the particular sensor node 19, and thus of the sensors 21 contained therein.

By means of the sensor network 3 presented herein and a method to be carried out therein for determining an identity of sensors 21 accommodated therein, the identity of the sensors 21 can be ascertained automatically. Modular sensor hardware may be installed, preferably anywhere within the passenger transport installation 1. Hardware of the sensor nodes 19 may also be interchangeable. The sensor-based monitoring hardware in a passenger transport installation 1 can thus be flexibly, easily and/or quickly installed and installation effort in the field can be reduced. Identities and in particular installation locations of potentially identical sensors 21 can be determined automatically in the sensor network 3, which can simplify installation of the sensor network 3 and help to prevent errors.

Finally, it should be noted that terms such as "comprising", "including", etc. do not preclude other elements or steps, and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A sensor network for a passenger transport installation, the sensor network comprising:

a master unit;

a signal transmission means;

a plurality of sensor nodes in signal communication with the master unit through the signal transmission means;

a plurality of sensors each for detecting a physical measured variable of the passenger transport installation and wherein each of the sensor nodes includes at least one of the sensors and transmits the detected measured variable to the master unit by the signal transmission means;

wherein the master unit includes a sensor detection module that determines an identity of the sensors included in the sensor nodes by using information previously stored in a database; and wherein the information previously stored in the database is at least one of, (i) a first type of information comprising information about reference measurement results to be typically provided under known conditions by particular sensors to be installed in the passenger transport installation, (ii) a second type of information comprising information about an identity of particular sensor nodes to be installed in the passenger transport installation, the identified particular sensor nodes comprising a plurality of different ones of the sensors or a plurality of same ones of the sensors in different configurations, and (iii) a third type of information comprising information about a pre-established configuration of particular sensor nodes to be installed in the passenger transport installation, the configured particular sensor nodes comprising a plurality of different ones of the sensors or a plurality of same ones of the sensors in different configurations.

2. The sensor network according to claim 1 wherein, using the first type of information, the master unit, during an initialization process in which the passenger transport installation is prompted to assume the known conditions, compares measurement results actually provided by one of the sensors in the sensor network with the reference measurement results previously stored in the database and determines the identity of the one sensor.

3. The sensor network according to claim 2 wherein the master unit, during the initialization process in which the passenger transport installation is prompted to move a passenger conveyor unit in a predetermined manner along a conveying path as part of a test run, records current accelerations measured by at least one acceleration sensor included in the sensor nodes and determines the identity of the at least one acceleration sensor recording the measured current accelerations based on a comparison of the recorded measured current accelerations with the reference measurement results.

4. The sensor network according to claim 1 wherein, using the second type of information, the master unit determines the identity of one of the sensors in the sensor network by comparing an identity signal transmitted by a one of the sensor nodes including the one sensor with the identity information previously stored in the database.

5. The sensor network according to claim 4 wherein each of the sensor nodes is configured to be installed only at an associated configurationally predetermined position within the passenger transport installation, wherein each of the sensor nodes includes an identity transmitting unit that transmits an identity signal specific to the sensor node in which it is included to the master unit, and wherein the master unit determines a position at which each of the sensors in the sensor network is installed within the passenger transport installation by comparing the identity signals transmitted by the identity transmitting units with the identity information previously stored in the database, the identity information indicating the configurationally predetermined positions within the passenger transport installation.

6. The sensor network according to claim 1 wherein, using the third type of information, the pre-established configuration includes information about a configuration-appropriate type of and a number of the sensors included in each of the sensor nodes, and wherein the master unit derives an actual type of and an actual number of the sensors included in one of the sensor nodes from measurement results actually transmitted by the one sensor node, and determines the identity of each of the sensors included in the one sensor node by comparing the derived actual type of and number of the sensors included in the one sensor node with the pre-established configuration information about the configuration-appropriate type of and the number of the sensors contained in the sensor nodes.

7. The sensor network according to claim 1 wherein a plurality of the sensors in the sensor network are identical in physical design.

8. The sensor network according to claim 1 wherein the signal transmission means is a bus system to which the sensor nodes are connected and by which each of the sensor nodes can direct signals generated by the sensors included therein to the master unit.

9. The sensor network according to claim 1 wherein the identity of each of the sensors in the sensor network includes information about an associated installation location within the passenger transport installation.

10. The sensor network according to claim 1 wherein the master unit includes a data memory in which the information previously stored in the database is stored.

11. A passenger transport installation being one of an elevator installation, an escalator and a moving walkway and including the sensor network according to claim 1.

12. A method for retrofitting an existing passenger transport installation, the method comprising the steps of:

installing the sensor network according to claim 1 in the existing passenger transport installation; and determining an identity of each of the sensors included in the sensor network using the information stored in the database.

13. A method for determining an identity of sensors in a sensor network for a passenger transport installation, wherein the sensor network includes a master unit, a signal transmission means, a plurality of sensor nodes, and a plurality of sensors each for detecting a physical measured variable and wherein each of the sensor nodes includes at least one of the sensors transmits the detected measured variable to the master unit by the signal transmission means, the method comprising the steps of:

storing information in a database, the stored information being at least one of, (i) a first type of information comprising information about reference measurement results to be typically provided under known conditions by particular sensors to be installed in the passenger transport installation, (ii) a second type of information comprising information about an identity of particular sensor nodes to be installed in the passenger transport installation, the identified particular sensor nodes comprising a plurality of different ones of the sensors or a plurality of same ones of the sensors in different configurations, and (iii) a third type of information comprising information about a pre-established configuration of particular sensor nodes to be installed in the passenger transport installation, the configured particular sensor nodes comprising a plurality of different ones of the sensors or a plurality of same ones of the sensors in different configurations; and determining an identity of each of the sensors using the information stored in the database.

* * * * *